US005829951A

United States Patent [19]

Adami

[11] Patent Number: 5,829,951

[45] Date of Patent: Nov. 3, 1998

[54] COLLECTING AND STACKING DEVICE FOR LAMINAR SHEETS AND STACKING METHOD

[75] Inventor: Mauro Adami, Viareggio Lucca, Italy

[73] Assignee: Fosber S.p.A., Lucca, Italy

[21] Appl. No.: 805,939

[22] Filed: Feb. 25, 1997

[30] Foreign Application Priority Data

Feb. 27, 1996 [IT] Italy ..... FI96A0037

[51] Int. Cl.[6] ..... B65H 31/10

[52] U.S. Cl. ..... 414/789; 414/790.7; 414/794.5; 414/802

[58] Field of Search ..... 271/302; 414/786, 414/789, 790.7, 794.5, 802

[56] References Cited

U.S. PATENT DOCUMENTS

| | | | |
|---|---|---|---|
| 3,191,927 | 6/1965 | Hartbauer et al. | 414/789 |
| 3,596,575 | 8/1971 | Brockmuller . | |
| 3,612,300 | 10/1971 | Berghgracht | 414/794.2 X |
| 3,683,758 | 8/1972 | Feldkamper | 414/789 X |
| 3,908,527 | 9/1975 | Brockmüller et al. . | |
| 4,200,276 | 4/1980 | Marschke . | |
| 4,313,600 | 2/1982 | Mosburger . | |
| 5,147,092 | 9/1992 | Driscoll et al. | 414/790.7 X |
| 5,415,389 | 5/1995 | Adami . | |

FOREIGN PATENT DOCUMENTS

| | | |
|---|---|---|
| 2 233 266 A | 10/1975 | France . |
| 28 52 603 | 6/1980 | Germany . |
| 40 13 116 A | 11/1991 | Germany . |

*Primary Examiner*—Janice L. Krizek
*Attorney, Agent, or Firm*—Breiner & Breiner

[57] ABSTRACT

The machine includes: a plurality of conveyors (3, 5, 7, 9, 13, 15) for sheets (F) of flat material to be stacked to form stacks or bundles (P); apparatus (6) for partially superimposing the sheets on each other; a surface (19) for the collection and stacking of the sheets; and removal apparatus (21, 23) for removing the stacks (P), the apparatus moving the stacks (P) in a direction substantially parallel to the direction of advance of the conveyors (3, 5, 7, 9, 13, 15). The stacking surface (19) is associated with a stop gate (33) movable in the direction of removal of the stacks and provided with a withdrawal movement to permit the discharge of the stacks (P) which are formed.

17 Claims, 13 Drawing Sheets

| CUT LGTH | KNF SPD |
|---|---|
| 0,50 | 108 |
| 0,60 | 124 |
| 0,70 | 139 |
| 0,80 | 153 |
| 0,90 | 166 |
| 1,00 | 177 |
| 1,10 | 188 |
| 1,20 | 198 |
| 1,30 | 208 |
| 1,40 | 217 |
| 1,50 | 225 |
| 1,60 | 233 |

Fig. 9

Fig. 10

| A | B | C | D | E | F |
|---|---|---|---|---|---|
| 500 | 108 | 30 | 32,4 | 15 | 197,03 |
| 550 | 135 | 30 | 40,5 | 15 | 223,99 |
| 600 | 166 | 30 | 49,8 | 15 | 251,33 |
| 650 | 215 | 27,907 | 60 | 13,953 | 278,57 |
| 700 | 262 | 22,901 | 60 | 11,45 | 295,31 |
| 750 | 295 | 20,339 | 60 | 10,169 | 311,54 |
| 800 | 330 | 18,182 | 60 | 9,0909 | 327,27 |
| 850 | 330 | 18,182 | 60 | 9,0909 | 342,54 |
| 900 | 330 | 18,182 | 60 | 9,0909 | 357,35 |
| 950 | 330 | 18,182 | 60 | 9,0909 | 371,74 |
| 1000 | 330 | 18,182 | 60 | 9,0909 | 385,71 |
| 1050 | 330 | 18,182 | 60 | 9,0909 | 399,3 |
| 1100 | 330 | 18,182 | 60 | 9,0909 | 412,5 |
| 1150 | 330 | 18,182 | 60 | 9,0909 | 425,34 |
| 1200 | 322 | 18,634 | 60 | 9,3168 | 437,84 |
| 1250 | 316 | 18,987 | 60 | 9,4937 | 450 |
| 1300 | 311 | 19,293 | 60 | 9,6463 | 461,84 |
| 1350 | 307 | 19,544 | 60 | 9,772 | 473,38 |
| 1400 | 304 | 19,737 | 60 | 9,8684 | 484,62 |
| 1450 | 304 | 19,737 | 60 | 9,8684 | 495,57 |
| 1500 | 305 | 19,672 | 60 | 9,8361 | 506,25 |
| 1600 | 304 | 19,737 | 60 | 9,8684 | 526,83 |

COLLECTING AND STACKING DEVICE FOR LAMINAR SHEETS AND STACKING METHOD

FIELD OF THE INVENTION

The present invention relates to an automatic collecting and stacking machine for sheets of flat material such as corrugated cardboard or the like. Machines of this type are typically disposed at the output end of a line for continuously forming corrugated cardboard, a slitter-scorer and a cross cutter which form sheets of material of the desired dimensions being disposed between the cardboard forming line and the stacker.

The invention also relates to a method of stacking.

PRIOR ART

There are at present various known automatic collecting and stacking systems, comprising a plurality of conveyors, means for superimposing on each other, with a specific degree of shingling, the sheets to be stacked, means for stacking the sheets, and a device which is used to create a break in the flow of sheets moving on the conveyors, without interruption of the feed to the machine, to permit the removal of a completed stack of sheets and the starting of a subsequent stack.

Machines of this type are described, for example, in US-A-5,415,389, US-A-4,200,276, US-A-4,313,600, and DE-C-28 52 603.

The operation of removing a complete stack and starting a new stack may slow down production. In many collecting and stacking machines, the sheets are stacked to form blocks of considerable height. The time required to form a block is relatively long and consequently only a few operations of removing one block and starting the formation of a subsequent block are necessary. The slowing of production is therefore not significant.

In other cases, the blocks or stacks of sheets are not formed directly by the collecting and stacking machine: the latter forms a series of bundles, each having a limited number of sheets. Each of these has to be removed from the stacker once it has been finished. In a section of the machine separate from the stacker, the individual bundles are then superimposed on each other to form complete blocks. This method is used when it is desired to obtain blocks of sheets formed in a highly regular way. Since each bundle has a limited number of sheets, the operations of removing the completed bundles are relatively frequent, and this has a negative effect on the rate of production.

OBJECTS AND SUAMMARY OF THE INVENTION

The object of the present invention is to provide an automatic collecting and stacking machine and a corresponding method which enable the rate of production to be increased by means of a special system of discharging the stacks or bundles of sheets.

Another object of the present invention is to provide a machine and a method which enable bundles of sheets containing a limited number of sheets to be produced while increasing the rate of production with respect to conventional systems.

A further object of the present invention is to provide a machine which makes it possible to avoid transient accelerations of the conveyors to above the normal operating speed.

The object of an improved embodiment of the invention is to provide a machine which can operate with bundles and with blocks, in other words either forming small bundles designed to be superimposed on each other to form a block outside the machine, or directly forming blocks at the output end of the stacker.

These and further objects and advantages, which will be clearly understood by those skilled in the art on reading the following text, are achieved with a machine in which removal means are provided in order to remove the stacks of sheets formed by the machine, said removal means moving the stacks in a direction substantially parallel to the direction of advance of said conveyors and in which a stop gate, movable in the direction of removal of the stacks and provided with a withdrawal movement to permit the discharge of the formed stacks, is associated with the stacking surface on which the stacks are formed.

In the context of the present description and of the attached claims, the parallel alignment of the direction of advance of the sheets and the direction of removal of the stacks is to be understood in the sense that both directions are oriented substantially in the longitudinal development of the processing line, whereas in conventional machines the bundles, the stacks or the blocks of stacked sheets are removed in a direction orthogonal to that of the development of the line.

Some manual machines designed in the past used the solution of removing the stacks of sheets longitudinally, in other words in the direction of advance of the sheets, but this solution proved to be unsuitable in the automatic machines existing hitherto.

In the solution according to the invention, however, the removal of the stack in the longitudinal direction, in combination with a movable stop or gate, drastically reduces the time required to remove the stack from the stacking surface. As will be clearly seen from the following description and from a comparison of the actual results of tests which have been conducted, with the same operating parameters the concept according to the invention halves the time needed to remove the stacks or bundles of sheets, and therefore (when each stack consists of a limited number of sheets) considerably increases the rate of production, which may be more than doubled. Moreover, since the time required to remove a stack of sheets and free the stacking surface is drastically reduced, the break which has to be created in the flow of incoming material, between one set of sheets designed to form a stack and the next set designed to form the next stack, may be very short. As an indirect consequence of this, it is possible to avoid transient accelerations above the normal operating speed of the conveyors. This results in more regular operation and the formation of more ordered stacks, and therefore a product of better quality. The typical transient accelerations of machines according to the known art entail the risk of misalignment of the sheets on the conveyors, with consequent difficulties in achieving regular stacking.

According to a particularly advantageous embodiment of the machine according to the invention, the stacking surface is formed by a pair of conveyors with corresponding drive systems. In this way, when small sheets are processed, it is possible to form the stack of sheets on the first conveyor. When this has to be removed, both the conveyors are activated, but the first can be stopped again as soon as the stack has moved on to the second conveyor. In this way, it is possible to start the formation of a new stack immediately on a stationary conveyor, avoiding having to start the new stack by placing the sheets on a moving conveyor and retaining them by means of the stop gate, with consequent sliding of the lowest sheet of the stack on the conveyor.

To achieve an extremely short stack removal time, it is particularly advantageous to have the gate carried by a moving element and is hinged to it. The moving element is provided with a reciprocating translational movement, while the gate is provided with a rotary translational movement so that it is rapidly withdrawn from the stack. When the stack removal operation starts, the moving element starts to be translated together with the stack, and the upward rotary translation of the gate starts at the same time. As soon as the gate is at a height such that it no longer interferes with the stack, the moving element can reverse its motion and return to the starting position, where the gate can be lowered until it touches the conveyor beneath it, on which it may be supported, for example, by means of idle rollers. At this point the first sheet of the new stack may have already arrived, with its leading edge bearing on the gate.

To reduce the stack removal times, it is advantageous to form the stack on a surface which is kept at a fixed height, while the conveyors which transport the sheets are raised gradually to keep up with the growth of the stack.

The machine may have a single stacking surface or two or more stacking surfaces, with a system of conveyors which may direct the sheets alternatively to one or other of said surfaces. The stacking surface, or one of the stacking surfaces (when there is more than one of these), may be provided with a raising and lowering movement and equipped with a double system of removal means, which allow the stacks of sheets formed on said surface to be removed alternatively in a direction substantially parallel to the direction of feed of the sheets or in a direction perpendicular to this. In this way the same machine may also be used in the conventional way, in other words with lateral or transverse discharge.

Further advantageous characteristics and embodiments of the machine and method according to the invention are indicated in the attached claims and will be described in greater detail in the following text.

BRIEF DESCRIPTION OF THE DRAWINGS

The invention will be more clearly understood from the description and the attached drawing, which shows a non-restrictive practical example of the invention. In the drawing:

FIG. 9 shows a first table of speeds for a conventional machine;

FIG. 10 shows a second table of speeds and operating parameters for a machine according to the invention.

DETAILED DESCRIPTION OF AN EMBODIMENT OF THE INVENTION

Figure 1A:
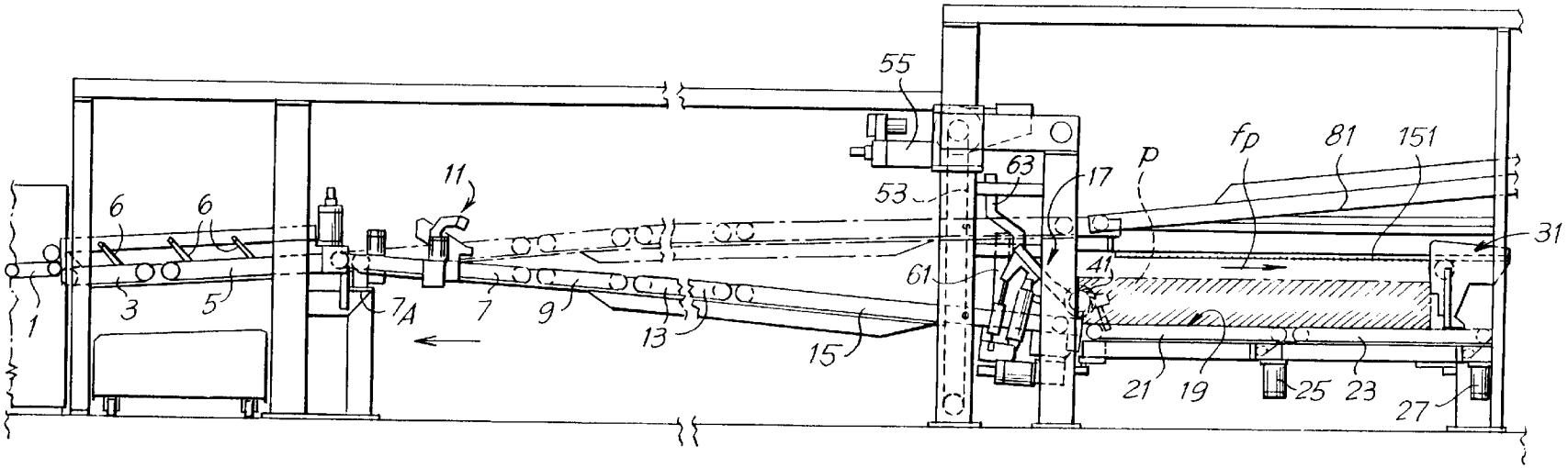
FIGS. 1A and 1B show a general lateral view of the machine.
Figure 1B:
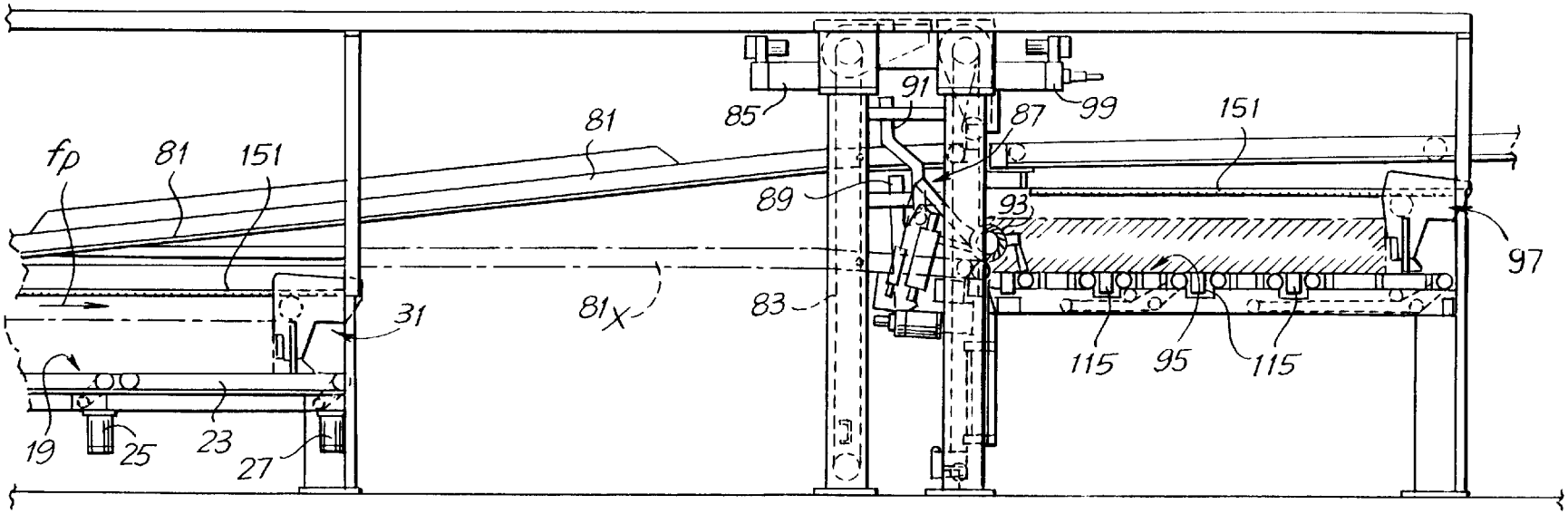

FIGS. 1A and 1B show schematically the machine as a whole. The machine has a first entry conveyor 1, which receives the sheets F of flat material (corrugated cardboard for example) and feeds them, with a certain space between them, to a pair of conveyors 3 and 5. If the speed of the strip material upstream of the stacker (in other words, in the case of a corrugated cardboard production line, the speed of production of the cardboard) is indicated by $v_N$, then the conveyor 1 has a speed of approximately 1.15–1.20 $V_N$, while the conveyors 3 and 5 have a speed of approximately 0.15 $v_N$. Consequently the sheets are disposed on the conveyors 3, 5 with a certain degree of reciprocal superimposition, in other words in a "shingled" configuration. This is made possible, in a known way, by the presence of brushes 6 or other equivalent means.

A set of conveyors 7, 9, 13, 15 is disposed downstream of the conveyor 5. The conveyor 7 is associated with a retaining clamp member, indicated as a whole by the number 11, whose structure and operation are analogous to those described in U.S. Pat. No. 5,415,389, the content of which is incorporated in the present description. The clamp 11 is used to hold back the advancing sheets F so as to create a break in the continuous flow of sheets when the stacker has completed a stack or bundle of sheets which has to be removed to permit the start of the formation of a subsequent bundle.

A discharge mechanism indicated as a whole by the number 17, illustrated in greater detail in the enlargement in FIG. 2 and described in the following text, is disposed downstream of the last conveyor 15. The sheets leaving the mechanism 17 are placed on a surface 19 formed by a pair of conveyor belts 21, 23, driven by two corresponding gearmotors 25, 27. FIG. 1A shows in broken lines a complete stack or bundle P of sheets, ready to be removed from the stacking area, by a movement in the direction of the arrow $f_p$. The methods of forming and removing the stack P will be described in greater detail below. The surface 19 is associated with a moving element indicated as a whole by the number 31 and provided with a gate 33 against which the sheets F bear to form a regular stack P. The moving element 31 is illustrated in detail in FIGS. 3 and 4 and will be described later.

The discharge mechanism 17 comprises a pressure roller 41 carried by an oscillating arm 43 hinged at 45 to a support 47, which is in turn hinged at 49 to a bracket 51 integral with the supporting frame of the conveyor 15. This conveyor can be raised and lowered together with the other conveyors 7, 9, 13 by a chain system 53, driven by a gearmotor 55 (FIG. 1A). The gradual raising movement of the conveyor 15 enables a stack P to be formed on the surface 19 which is kept at a fixed height. During the raising movement of the conveyors 7, 9, 13, 15, the discharge end of the conveyor 15 is guided by two guide rollers 57, 59 which run in two guides 61, 63. The entry end of the conveyor 7 is simply supported on a support 7A, and the position of the system of conveyors 7, 9, 13, 15 is thus determined (during the raising carried out by the chain 53) by the support 7A and the guides 61, 63.

Figure 2:
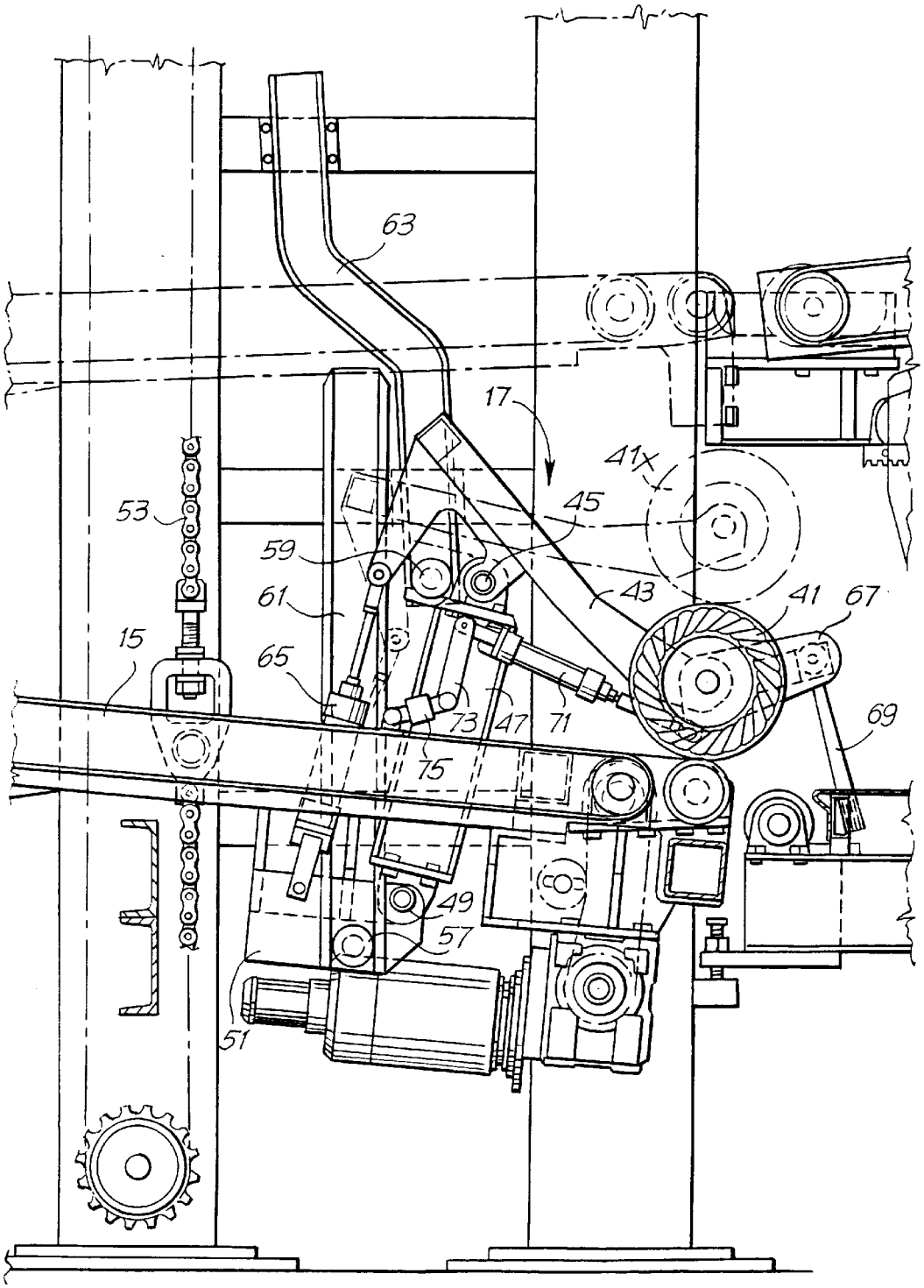
FIG. 2 shows a detail of the area of discharge of the sheets from the conveyors.

A pneumatic cylinder and piston actuator 65 keeps the pressure roller 41 pressed toward the conveyor 15 and therefore against the sheets F which move on it and enables the pressure roller 41 to be raised, when commanded, into the disengaged position 41X shown in broken lines in FIG. 2.

An oscillating bracket 67 which carries at one of its ends a brush 69, which keeps the sheets leaving the conveyor 15 pressed downward, is pivoted about the axis of the pressure roller 41. At its opposite end, the oscillating bracket 67 is connected to an air spring 71 and, through an oscillating arm 73 connected to the support 47, to an actuator 75 which can disengage the brush 69.

As shown in FIG. 1A, the group of conveyors 7, 9, 13, 15 can be brought to an upper position, shown in broken lines, in which it is aligned with a further conveyor 81. When the conveyors 7, 9, 13, 15 are in this position, the pressure roller 41 and the brush 69 are held in the raised position, and the sheets F of flat material move directly on to the conveyor 81. The conveyor 81 is connected to a chain 83 which, by means of a gearmotor 85, can raise and lower it. FIG. 1B shows the two extreme positions which the conveyor 81 may assume, the position of maximum lowering being indicated by 81X and illustrated in broken lines. A second discharge mechanism 87, substantially identical to the mechanism 17 and not described further, is disposed at the discharge end of the conveyor 81. The numbers 89 and 91 indicate two guides equivalent to the guides 61 and 63. The number 93 indicates the corresponding pressure roller equivalent to the roller 41.

When the sheets F are diverted to the conveyor 81, they are discharged on to a surface 95 consisting of a set of conveyors which will be described in greater detail with reference to FIGS. 5, 6 and 7. The surface 95 is associated with a moving element 97 which is entirely equivalent to the moving element 31 associated with the surface 19 and is not described further.

The conveyor 81 can discharge the sheets F on to the surface 95 in the same way as the conveyor 15 discharges on to the surface 19, in other words by keeping the surface 95 stationary and gradually raising the conveyor 81 by means of the chain 83 and the gearmotor 85. Conversely, the discharge and stacking may be carried out by keeping the conveyor 81 in a fixed position and gradually lowering the surface 95. For this purpose, the surface 95 is slidable along vertical guides and is associated with a gearmotor 99 which, by means of chain members 101 (FIG. 5), gradually lowers the surface 95 during the stacking phase and raises it again rapidly after the discharge of one stack and before the stacking of a subsequent stack is started.

Figure 5:
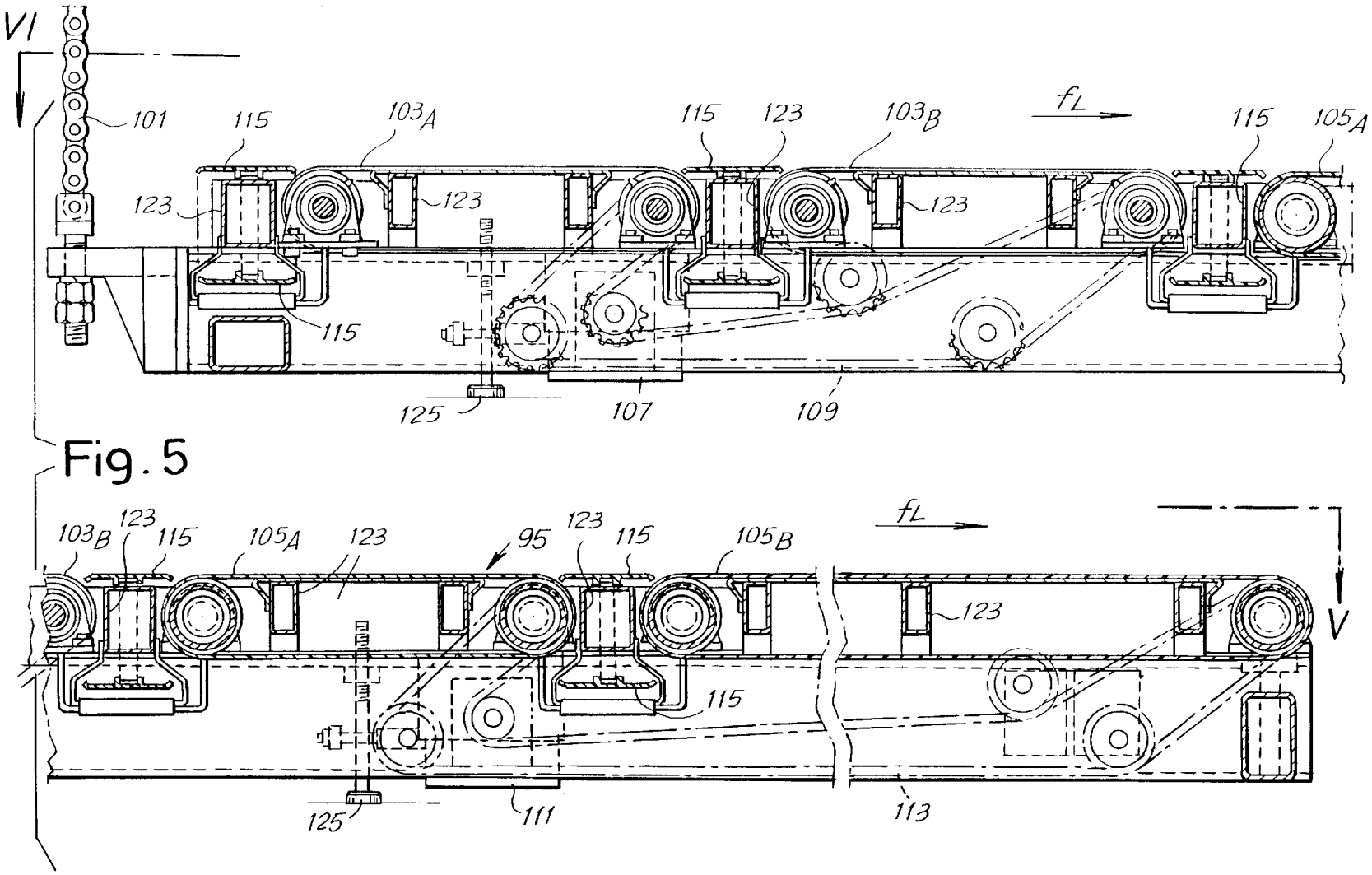
FIG. 5 shows a section of the second stacking surface through V—V in FIG. 7.
Figure 6:
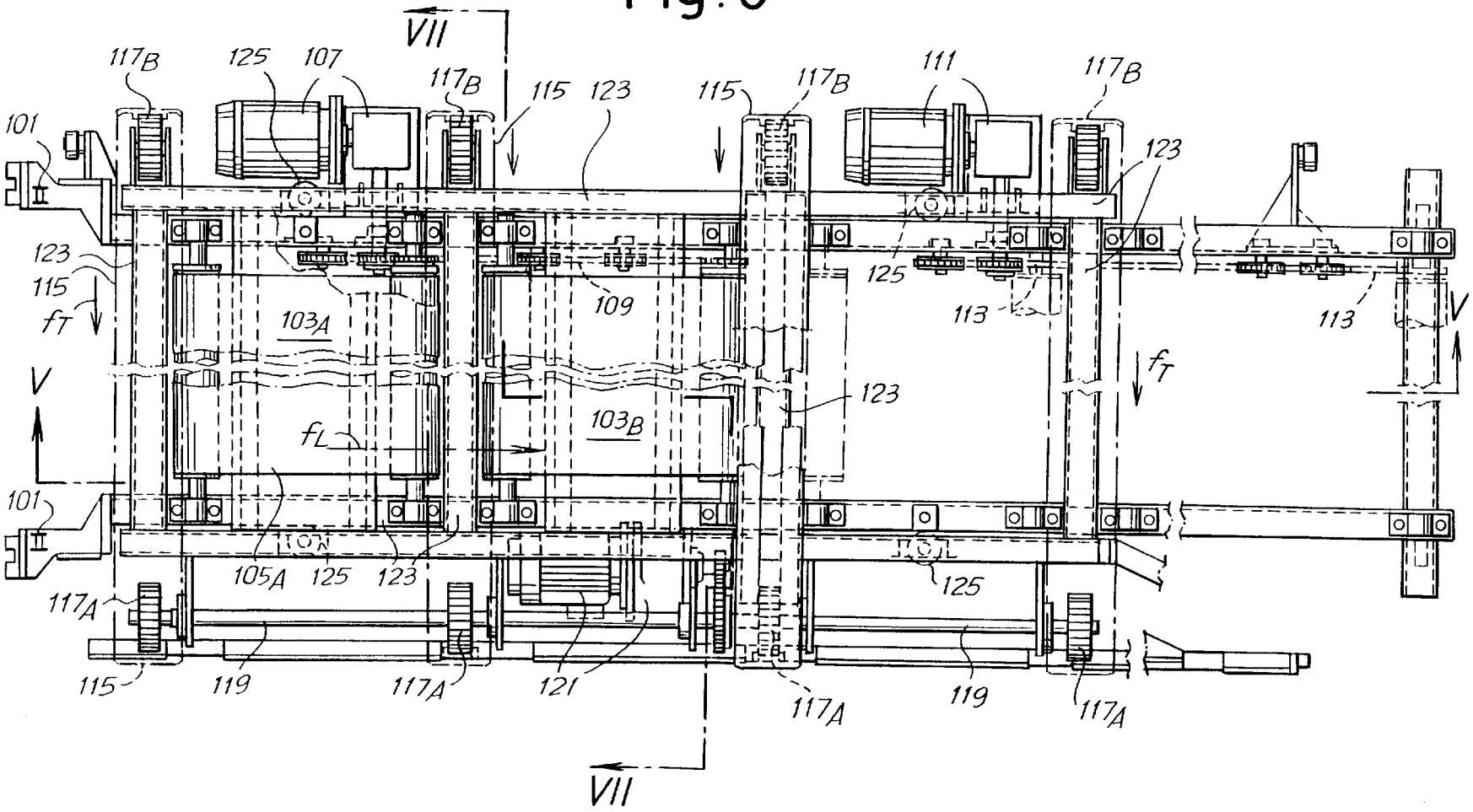
FIG. 6 shows a plan view, with parts removed, of the surface shown in FIG. 5.
Figure 7:
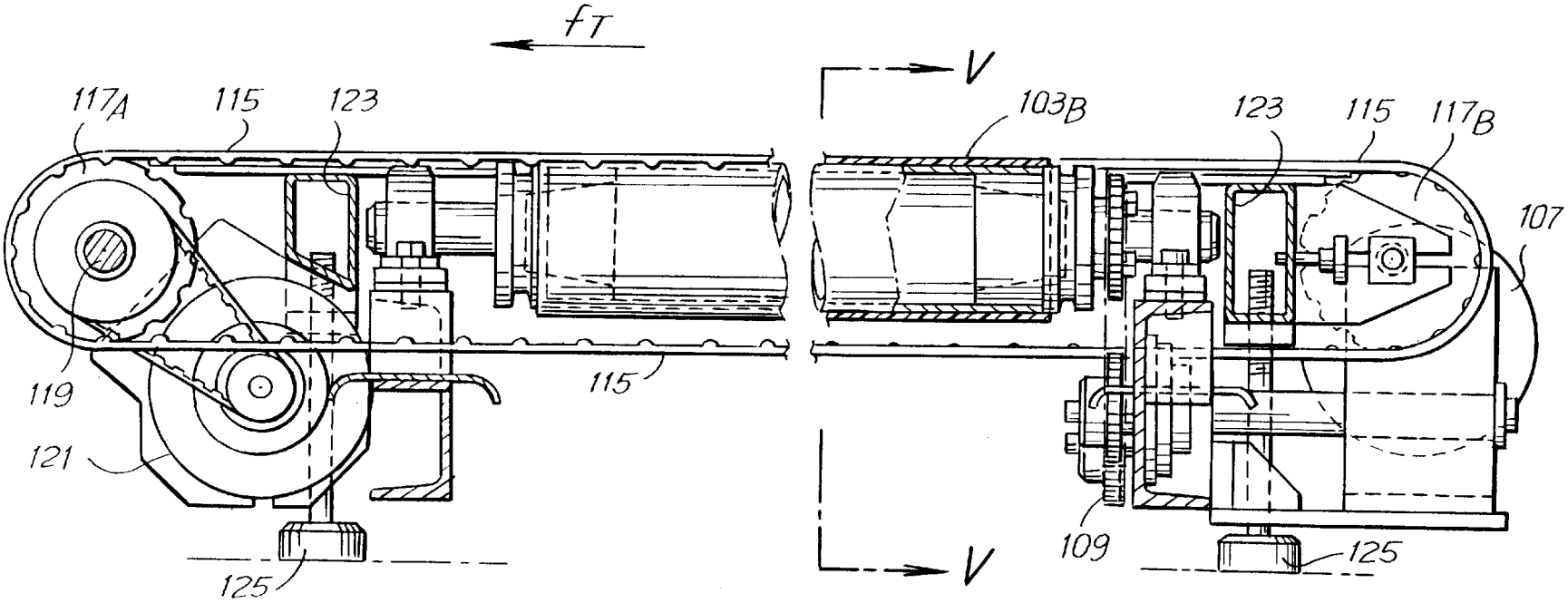
FIG. 7 shows a cross section through VII—VII in FIG. 6.

As may be seen in FIGS. 5, 6 and 7, the surface 95 is formed by a plurality of flexible members 103A, 103B, 105A and 105B, which form two longitudinal conveyors. The first longitudinal conveyor is formed by the flexible members 103A, 103B, and is driven by a gearmotor 107 through a chain 109. The second longitudinal conveyor is formed by the flexible members 105A, 105B, and is driven by a gearmotor 111 through a chain 113. The longitudinal conveyors described above are used to move a stack of sheets F in the longitudinal direction $f_L$. They alternate with the sections of a transverse conveyor consisting of a set of four continuous belts 115 running around corresponding pairs of pulleys 117A, 117B. The pulleys 117A are keyed to a common drive shaft 119 driven by a gearmotor 121. The belts 115, the corresponding pulleys 117A, 117B, the drive shaft 119 and the gearmotor 121 are carried on a frame 123 provided with feet 125 which, when the surface 95 is lowered, touch the ground and raise the belts 115 with respect to the flexible members 103A, 103B, 105A and 105B. In this way, if a stack of sheets F is positioned on the surface 95 and if the surface 95 is lowered until the feet 125 touch the ground, the stack of sheets is raised on the belts 115 and can be removed by them in a transverse direction $f_T$ (FIG. 6), in other words in a direction orthogonal to the direction $f_L$.

With this disposition, the stacks of sheets accumulated on the surface 95 can be removed transversely or longitudinally from the surface, in other words by a movement substantially parallel to the sheet feed movement or perpendicular to it.

Figure 3:
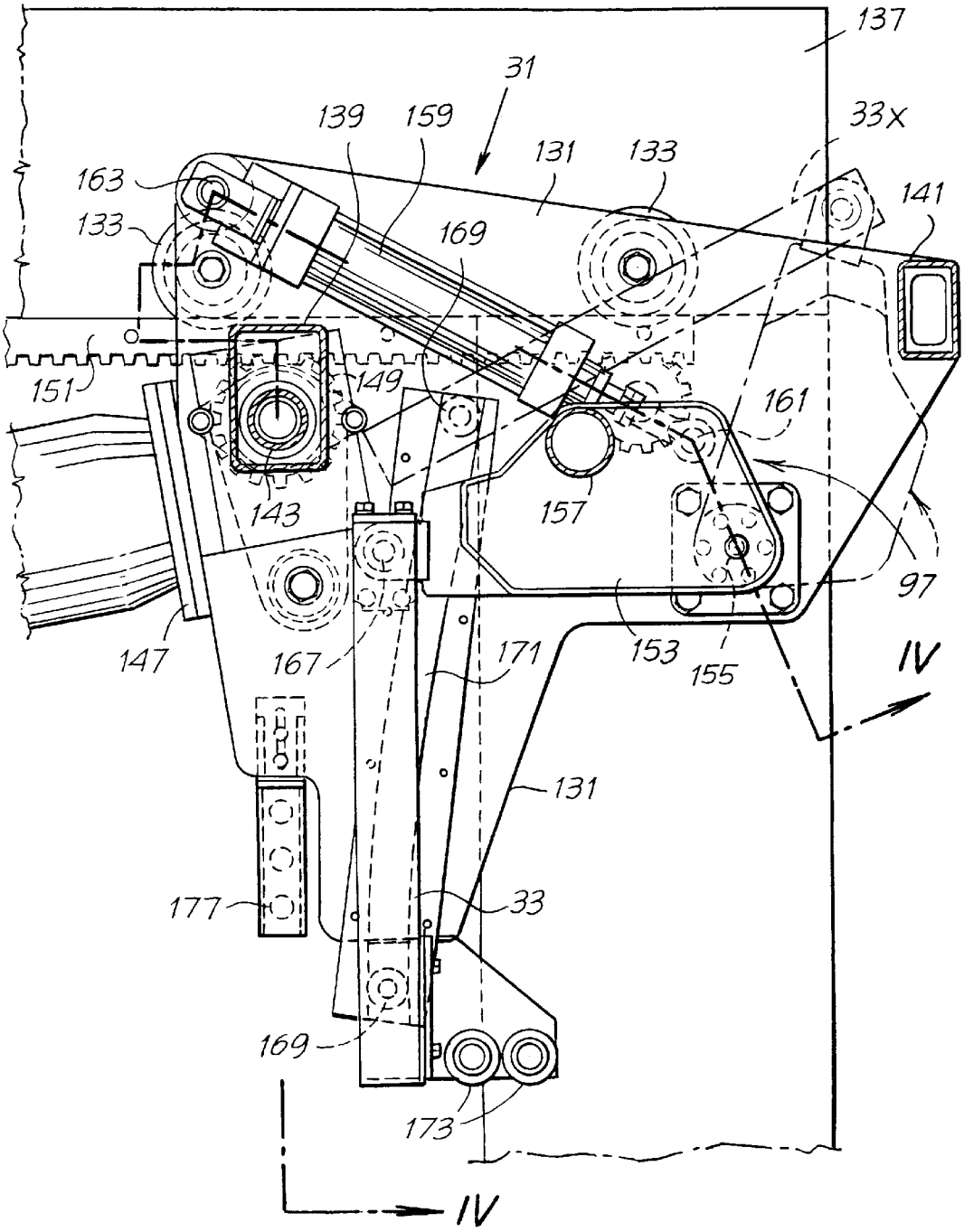
FIG. 3 shows a longitudinal section through the moving element carrying the gate or stop for the formation of the stacks of sheets.
Figure 4:
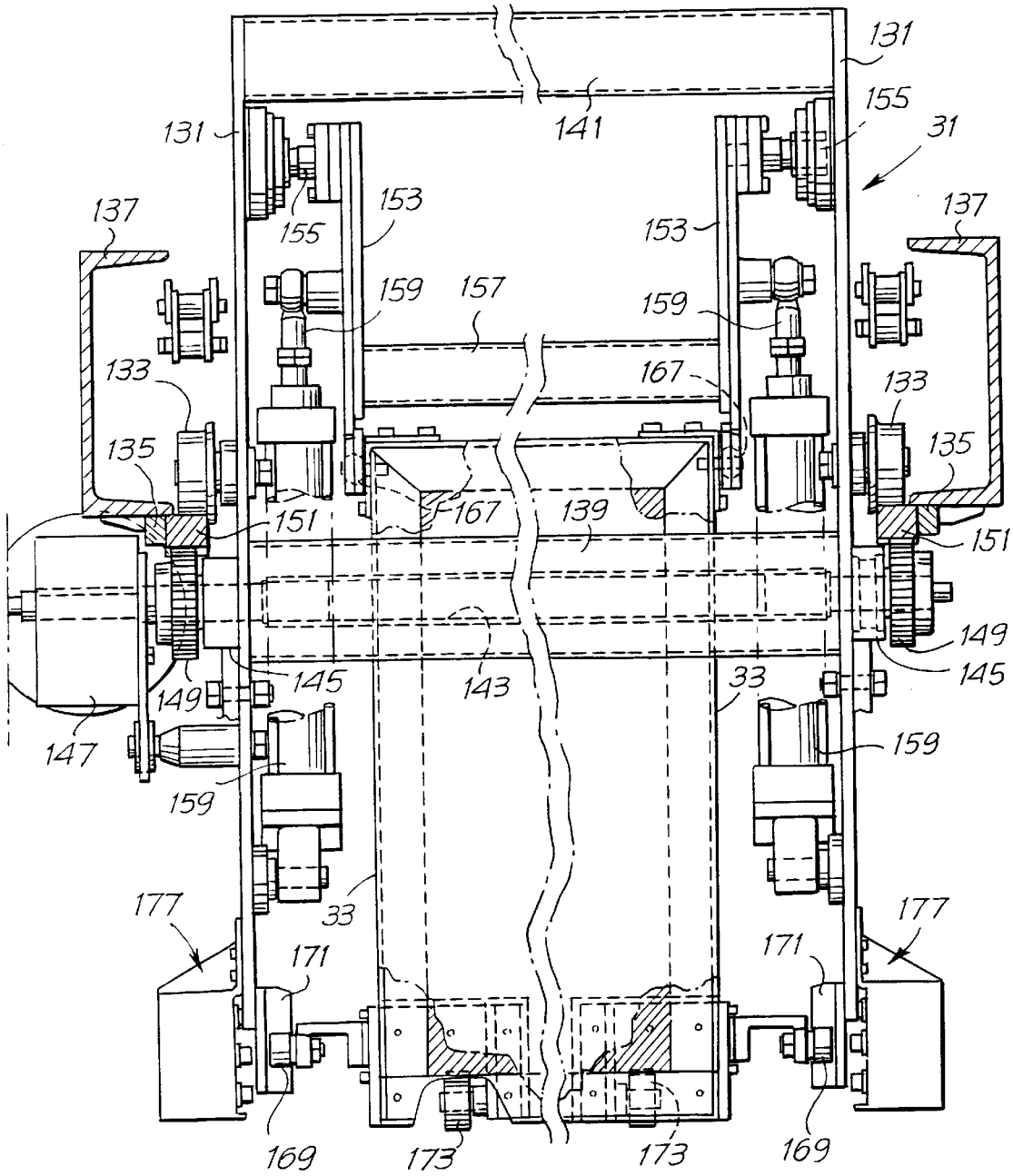
FIG. 4 shows a section approximately through the line IV—IV in FIG. 3.

With reference to FIGS. 3 and 4, the moving element 31 will now be described in detail. It comprises two side frames 131, each provided with two rollers 133 which guide the side frames along two longitudinal guides 135 carried by two cross-pieces 137. The two side frames 131 are joined together by cross-pieces 139, 141. A shaft 143 carried by the side frames 131 by means of corresponding supports 145 passes through the inside of the cross-piece 139. The shaft 143 is driven by a gearmotor 147 carried on the outside of one of the two side frames 131, and two gear wheels 149 engaging with two corresponding racks 151 are keyed on the shaft 143. The disposition described above permits the longitudinal translation of the moving element 31 in the direction of the arrow $f_p$(FIG. 1A).

The gate 33 is connected to the side frames 131 by a pair of oscillating plates 153 hinged at 155 to the side frames 131. The oscillating plates 153 are connected together by a tubular torsion bar 157 and are connected to two corresponding cylinder and piston actuators 159. The rod of each actuator 159 is hinged at 161 to the corresponding plate 153, while the cylinder is hinged at 163 to the corresponding side frame 131. The actuators 159 cause the plates 153 to oscillate about the axis of the supports 155.

The gate 33 is hinged to the two oscillating plates 153 about a horizontal axis 167. At the lower end opposite the axis 167 the gate 33 is provided with two rollers 169 engaged in two guides 171 integral with the side frames 131. When the actuators 159 cause the clockwise rotation of the plates 153, the gate 33 is raised and is guided in this movement by the rollers 169 engaged in the guides 171, so that the gate 33 is raised from the position indicated in solid lines in FIG. 3 to the position shown in broken lines in said figure and identified therein by the number 33X.

The gate 33 is also provided with four idle rollers 173 by which it is supported on the surface 19 (FIG. 1A).

FIGS. 3 and 4 also show the presence of sensors 177 for measuring the level of the stack being formed. In fact, these sensors are present only in the moving element 97 and are used when the stack is formed by lowering the stacking surface instead of by raising the conveyor 81.

The operation of the machine described above will be illustrated with reference to the sequence of FIGS. 8A–8E. These show the formation of a stack or bundle P of sheets F on the surface 19. It is evident that the same modes of operation are used when the stack is formed on the surface 95.

Figure 8A:
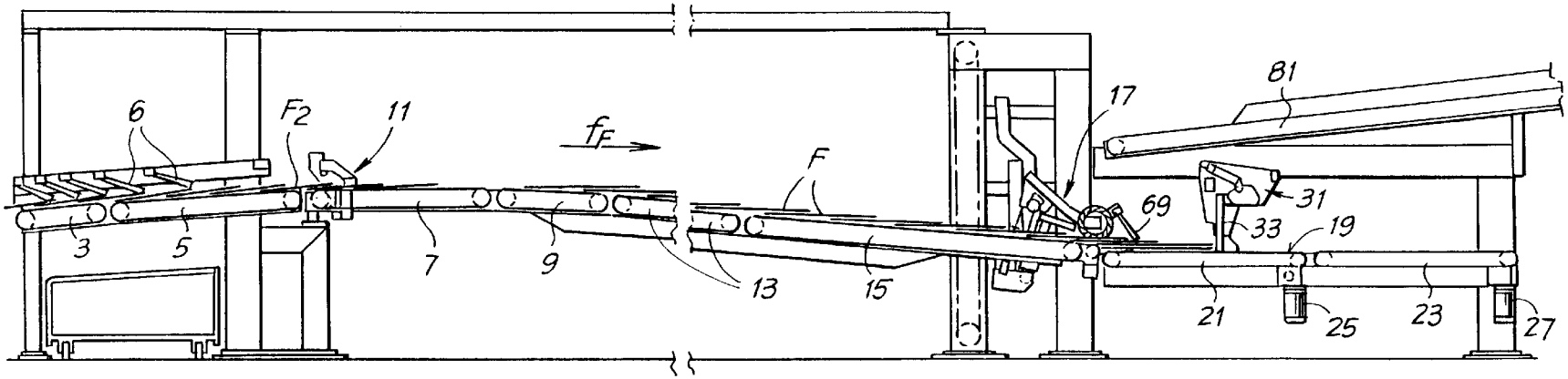
FIGS. 8A–8E show successive phases of the operating cycle of the machine.

FIG. 8A shows the initial phase of the formation of the stack P on the surface 19 formed by the upper run of the conveyors 21, 23. The moving element 31 is in a position such that the gate 33 (which is in a lowered and approximately vertical position) forms a stop for the alignment of the sheets F arriving from the conveyor 15 and discharged by the discharge mechanism 17.

On the conveyors 9, 13, 15 there is a first set of sheets F, superimposed on each other with a predetermined shingling, which have to be stacked to form a bundle or stack on the surface 19. There is a break in the flow of sheets in the area of the transition from the conveyor 7 to the conveyor 9. Upstream of this break, with respect to the direction of advance $f_F$ of the sheets, there is a second set of sheets $F_2$ intended to form a second stack of sheets. The following method is used to create the break between the first and second set of sheets: when the last sheet F of the first set and the first sheet $F_2$ of the second set have been identified by a known method, the latter sheet is gripped by the movable clamp 11 which raises and retains said first sheet. The sheets f of the first set continue to advance at the nominal operating speed, equal to approximately 15% of the speed of the entry conveyor 1, while the clamp 11 starts to advance in the direction of the arrow $f_F$ at a speed of approximately 50% of the nominal operating speed. At the same time, the conveyors 3 and 5 have decelerated to a speed of the order of 50% of the normal operating speed. This causes a temporary deceleration of the front of the second set of sheets $F_2$ and an increase in the shingling of the sheets on each other. The result is the creation of a break between the first and second sets.

Figure 8B:
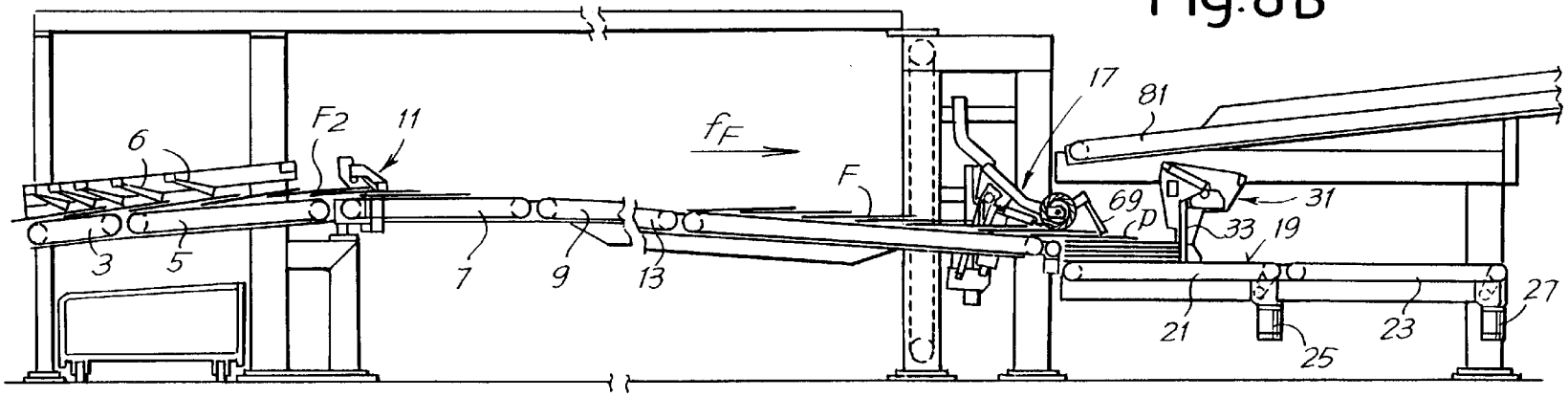

While the sheets F of the first set continue to advance at the normal operating speed and are stacked on the surface 19 to form the stack P, as the sheets of the first set are removed from the conveyors 7, 9, 13, these conveyors decelerate from the normal operating speed to the reduced speed. The reduced speed is maintained until a break sufficient to permit the removal of the formed stack and the repositioning of the stop gate has been formed between the trailing edge of the last sheet of the first set and the leading edge of the first sheet of the last set. In FIG. 8B, the break between the two sets of sheets is greater than the initial break shown in FIG. 8A, the sheets of the first set have left the conveyors 7, 9 and 13, which can then be decelerated to the reduced speed of the conveyors 3 and 5, while the movable clamp 11, which has executed an advance movement to accompany the first sheets $F_2$ of the second set at a reduced speed, can open and return.

Figure 8C:
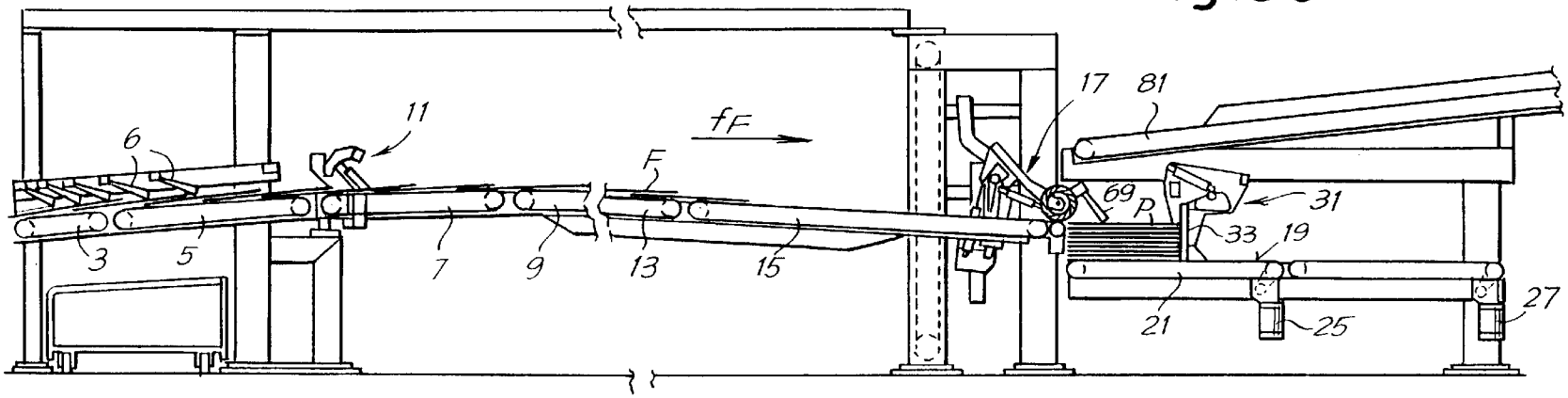

In FIG. 8C, all the sheets F of the first set have been stacked, and the leading edge of the second set of sheets $F_2$ is reaching the conveyor 15. The conveyors 3, 5, 7, 9, 13, 15 may be made to run at the normal operating speed if the break which has been created is sufficient to permit the removal of the stack P and the repositioning of the gate 33.

Figure 8D:
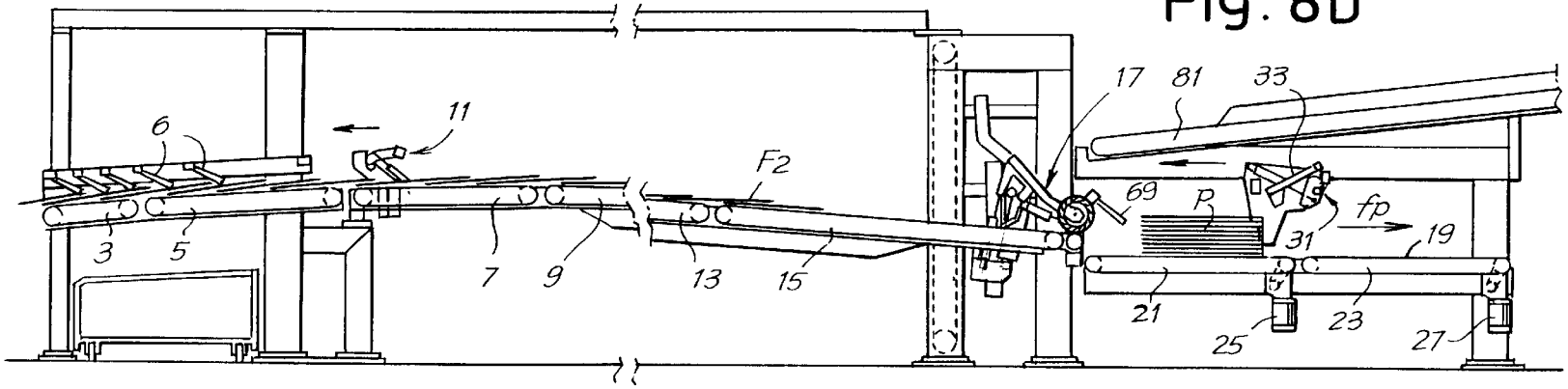
Figure 8E:
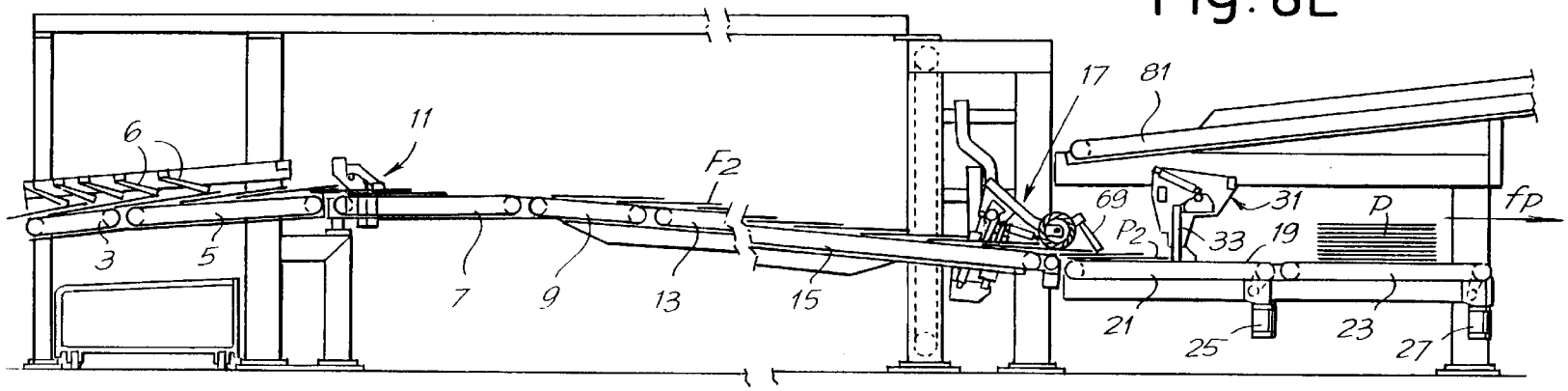

FIG. 8D shows the start of the phase of removal of the formed stack P: the moving element 31 starts to advance in the direction $f_p$, in other words in the direction of feeding of the sheets; during this movement, the gate 33 is raised; at the same time, the advance of the conveyor belts 21, 23 is started, and the stack P starts to advance in the direction $f_p$. When the gate 33 has been raised, the moving element 31 can reverse its motion and return toward the conveyor 15, passing over the stack P which continues to advance in the direction $f_p$. When the moving element 31 reaches the position shown in FIG. 8A, the gate 33 is lowered again. FIG. 8E shows the phase in which the moving element 31 has been returned to the initial position shown in FIG. 8A and the gate 33 has been lowered, while the stack P is moved on to the conveyor 23. The conveyor 21 can be halted as soon as the stack P has moved on to the conveyor 23. In the configuration shown in FIG. 8E, the sheets $F_2$ of the second set start to accumulate on the surface 19 to form a new stack $P_2$.

FIGS. 8A–8E also show the gradual raising and lowering movement of the group of conveyors which enables the stack to be formed while keeping the surface 19 at a fixed height.

When the sheets F, $F_2$ are carried on the conveyor 81, the process described above may be executed on the collecting surface 95 in a completely identical way.

The movement of the moving element 31 and of the gate 33 described above, in combination with the movement of the discharge of the stacks P in the direction $f_p$, drastically reduces the time required to free the surface 19 in the stacking area, and therefore reduces the slow advance phase of the collector and stacker. Consequently, the flat material may be fed to the collector and stacker at a higher speed than in conventional machines. When the collector and stacker is placed downstream of a corrugating machine for the formation of a strip of corrugated cardboard, it becomes possible to make the corrugating machine operate at a higher speed. The time is reduced in such a way that the break between the sheets of the first set and the sheets of the second set can be relatively short and can be obtained without accelerating the conveyors above the nominal operating speed, with the advantage of regularity of operation and of the quality of the end product, in terms of regularity of the stack P which is formed. A plurality of sets of sheets, separated by corresponding break areas, may be present simultaneously on the set of conveyors. Since the speed of the conveyors does not exceed the normal operating speed, the correct distance between successive sets of sheets is always maintained in this case also.

FIG. 9 shows a table of data relating to a conventional machine. The left-hand column shows the lengths in millimeters of the sheets F and the right-hand column shows the speeds which may be reached by a corrugating machine combined with a conventional collecting and stacking machine, as a function of the length of the individual sheets F. The data used for the calculation are as follows:

height of the stack or bundle: 315 mm
thickness of an individual sheet: 7 mm
number of sheets per stack: 45.

The sheets are stacked on a movable platform and the stacks are discharged transversely, in other words by a movement orthogonal to the direction of advance of the conveyors. The following parameters were assumed for the calculation:

travel of the platform: 600 mm
mean speed of descent of the platform: 166 mm/s
stack ejection time: 5 seconds
mean speed of upward return of the platform: 200 mm/s
normal operating speed of the conveyor belts: 0.8 m/s
shingling percent: 10%.

As may be seen in the table in FIG. 9, for sheets with a length of 500 mm the speed of the corrugating machine is 108 m/min., increasing to 233 m/min. for sheets with a length of 1600 mm.

FIG. 10 shows a table of data relating to the machine according to the invention, obtained with the following parameters (corresponding to those above):

height of the stack or bundle: 315 mm
thickness of an individual sheet: 7 mm
number of sheets per stack: 45
time for removing the stack and repositioning the gate: 2.5 seconds The columns of the table in FIG. 10 show the following values (from left to right):

length of sheets in mm (column A);
speed of the cutter which transversely cuts the strip leaving the corrugating machine to form the sheets F (column B);
shingling percent in normal operating conditions (column C);
normal operating speed of the conveyors, in m/min. (column D);

shingling percent in the deceleration phase for the creation of the break between successive sets of sheets (column E); maximum speed of the corrugating machine in m/min. (column F).

As may be clearly seen from a comparison of the tables in FIG. 9 and FIG. 10, the collecting and stacking machine according to the invention provides rates of production that are approximately twice as high for the same operating conditions and sheet sizes. For example, for sheets of 500 mm, rates of production of the corrugated cardboard strip equivalent to 197.03 m/min. are obtained with the machine according to the invention, while rates of only 108 m/min. are obtained with a conventional machine. With 1600 mm sheets, the advantage is even greater: 526.83 m/min. with the machine according to the invention and only 233 m/min. with conventional machines.

Figure 11:
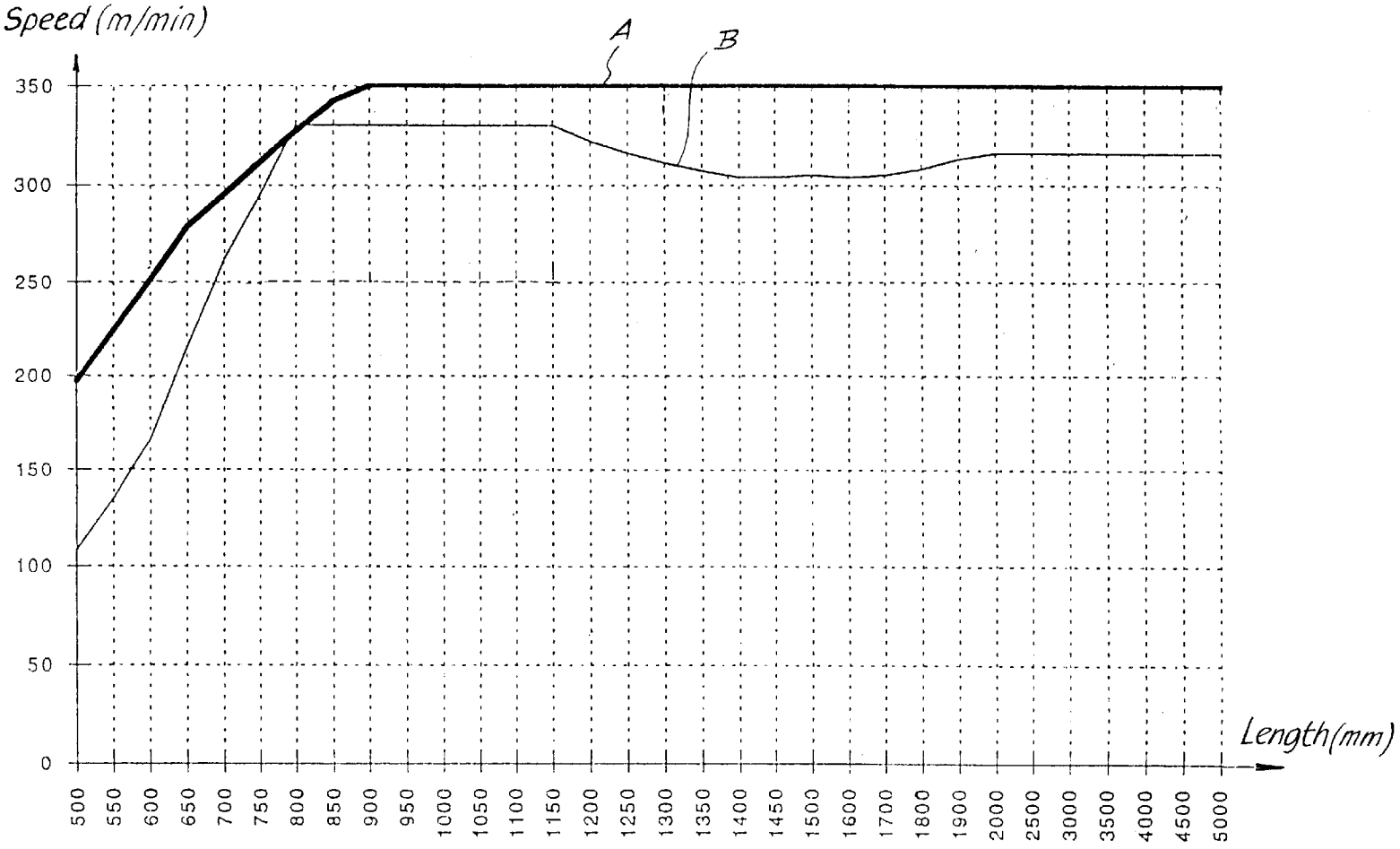
FIG. 11 shows a speed diagram plotted from the data in the table in FIG. 10.

FIG. 11 shows a diagram whose horizontal axis shows the length of the sheets and whose vertical axis shows the speed in m/min. of the corrugating machine (curve A) and the cutter (curve B).

It is to be understood that the drawing shows only an example provided solely as a practical demonstration of the invention, and that this invention may vary in its forms and dispositions without thereby departing from the scope of the guiding concept of the invention. Any reference numbers in the appended claims have the purpose of facilitating the reading of the claims with reference to the description and to the drawing, and do not limit the scope of protection represented by the claims.

I claim:

1. A collecting and stacking machine comprising a plurality of conveyors for conveying sheets of flat material to be stacked to form a succession of stacks of a specified number of said sheets; apparatus for partially superimposing adjacent sheets of said sheets; a surface for collecting and stacking said sheets; and removal apparatus for removing said stacks of said sheets formed on said surface, wherein said removal apparatus moves the stacks in a direction substantially parallel to a direction of advance of said conveyors; and said surface for collecting and stacking is positioned in relation to a gate, said gate being constructed and arranged to perform a withdrawal movement lifting the gate to permit removal of the stacks formed and a reciprocating movement in a direction of removal of the stacks so as to move with a stack being removed and in a return direction passing above said stack being removed in order to move back to a stacking position.

2. The machine as claimed in claim 1 wherein said surface for collecting and stacking is formed by a plurality of conveyors with corresponding drive systems.

3. The machine as claimed in claim 1 wherein said gate is carried by a moving element and is hingedly connected to the moving element.

4. The machine as claimed in claim 3 wherein said gate has a rotational movement and a translation movement, said rotational movement and said translation movement serving to move the gate from a working position, in which the gate is supported on the surface for collecting and stacking to form a positioning stop for the sheets during stacking, to a withdrawn position in which the gate is above a stack formed on said surface.

5. The machine as claimed in claim 1 wherein said surface for collecting and stacking is disposed at a height which is kept fixed during stacking, and said conveyors are constructed and arranged to be raised and lowered during operation.

6. The machine as claimed in claim 5 wherein said conveyors are constructed and arranged to have a translation movement in a horizontal direction in combination with raising and lowering of said conveyors.

7. The machine as claimed in claim 1 further comprising at least two surfaces for collecting and stacking.

8. The machine as claimed in claim 1 further comprising at least one surface for collecting and stacking which is constructed and arranged to be raised and lowered and is equipped with a dual system for removal which allows stacks of sheets formed on said at least one surface for collecting and stacking to be removed alternatively in a direction substantially parallel to a direction of feed of the sheets or in a direction perpendicular to the direction of feed of the sheets.

9. The machine as claimed in claim 8 wherein said at least one surface for collecting and stacking is formed by a set of at least two longitudinal conveyors with corresponding drive systems which move a stack in a direction substantially parallel to the direction of feed of the sheets, and a transverse conveyor intersecting said at least two longitudinal conveyors.

10. The machine as claimed in claim 9 wherein each of said at least two longitudinal conveyors includes at least a pair of flexible members which are driven by a single drive system and between which continuous members extend to form said transverse conveyor.

11. The machine as claimed in claim 9 wherein said transverse conveyor and said at least two longitudinal conveyors are movable vertically with respect to each other.

12. The machine as claimed in claim 11 wherein said transverse conveyor is mounted on a frame provided with supporting feet which, when the surface for collecting and stacking is lowered, come into contact with a support surface and raise said transverse conveyor with respect to said at least two longitudinal conveyors.

13. The machine as claimed in claim 1 wherein said conveyors have speeds that vary between at least one first normal operating value and a second transient value which is lower than said first normal operating value, to permit formation of a break between a first set of sheets intended to form a first stack and a second set of sheets intended to form a second stack.

14. The machine as claimed in claim 13 further comprising a movable clamp which grips a first sheet of said second set of sheets so as to create said break.

15. A method for collecting and stacking sheets of flat material to form a succession of stacks of said sheets, said method comprising disposing a plurality of conveyors to receive a flow of said sheets in a configuration of partial superimposition;

stacking a first set of said sheets on a stacking surface to form a first stack while aligning said sheets against a gate positioned in relation to said surface;

creating a break in the flow of said sheets on said conveyors to separate the first stack from said stacking surface; and starting formation of a second stack of said sheets on said stacking surface;

wherein:

each stack formed is removed in a removal direction which is substantially parallel to a direction of advance of said sheets;

said gate is lifted to a withdrawn position with respect to a stack while the stack is moving in said removal direction and said stack during removal of said stack; and when said gate has reached said withdrawn position, the gate is moved above said stack being moved in the removal direction in a direction opposite said removal direction and returned to a stacking position to start formation of a next successive stack.

16. The method as claimed in claim 15 wherein in creating said break to produce the first set of said sheets and the second set of said sheets, some of said plurality of conveyors are gradually brought from a first normal operating speed to a second transient speed which is lower than said first normal operating speed.

17. The method as claimed in claim 16 wherein size of said break is proportional to time which is needed for removal and subsequent repositioning to said gate.

* * * * *

UNITED STATES PATENT AND TRADEMARK OFFICE

CERTIFICATE OF CORRECTION

PATENT NO. : 5,829,951

DATED : November 3, 1998

INVENTOR(S) : Mauro Adami

It is certified that error appears in the above-indentified patent and that said Letters Patent is hereby corrected as shown below:

Claim 15, column 10, lines 55-57,

"creating a break in the flow of said sheets on said conveyors to separate the first stack from said stacking surface; and" should read -- creating a break in the flow of said sheets on said conveyors to separate the first set of said sheets from a second set of said sheets; removing said first stack from said stacking surface; and --;

Claim 15, column 10, lines 66-67, "direction and said stack during removal of said stack; and" should read -- direction and said gate partially accompanies movement of said stack during removal of said stack; and --.

Signed and Sealed this

Fourth Day of May, 1999

*Attest:*

*Attesting Officer*

Q. TODD DICKINSON

*Acting Commissioner of Patents and Trademarks*